US005255852A

United States Patent [19]

Morrison

[11] Patent Number: 5,255,852

[45] Date of Patent: Oct. 26, 1993

[54] SPRAY-TYPE DISPENSING APPARATUS

[75] Inventor: Adam P. Morrison, Rockford, Ill.

[73] Assignee: The Testor Corporation, Rockford, Ill.

[21] Appl. No.: 916,548

[22] Filed: Jul. 20, 1992

[51] Int. Cl.[5] ..... B05B 7/24

[52] U.S. Cl. ..... 239/346; 239/426; 239/434

[58] Field of Search ..... 239/310, 346, 426, 434, 239/311

[56] References Cited

U.S. PATENT DOCUMENTS

| | | | |
|---|---|---|---|
| 2,550,404 | 4/1951 | Chasan et al. | 239/346 |
| 2,635,921 | 4/1953 | Deutsch | 239/426 |
| 2,772,118 | 11/1956 | Cornelius | 239/346 |
| 3,058,669 | 10/1962 | Drell | 239/426 |
| 3,084,870 | 4/1963 | Hagadorn | 239/305 |
| 3,085,752 | 4/1963 | Drell | 239/426 |
| 3,107,058 | 10/1963 | Corbett | 239/346 |
| 3,180,578 | 4/1965 | Hagadorn | 239/307 |
| 3,454,228 | 7/1969 | Mossop | 239/308 |
| 4,020,990 | 5/1977 | Luff | 239/346 |
| 4,606,501 | 8/1986 | Bate et al. | 239/346 |
| 4,681,262 | 7/1987 | Sprute | 239/346 |

*Primary Examiner*—Andres Kashnikow
*Assistant Examiner*—Lesley D. Morris
*Attorney, Agent, or Firm*—Fay, Sharpe, Beall, Fagan, Minnich & McKee

[57] ABSTRACT

An air brush type liquid spraying apparatus which has a unitary main frame and control valve assembly. The apparatus includes a combined liquid container and discharge nozzle assembly which can be quickly removed and replaced as a unit from the main frame and control valve assembly to allow rapid, simple change-over to a different dispensed liquid.

13 Claims, 2 Drawing Sheets

SPRAY-TYPE DISPENSING APPARATUS

BACKGROUND OF THE INVENTION

The subject invention is directed toward the art of fluid dispensing devices and, more particularly, to an apparatus for spray dispensing of liquids.

The invention is particularly useful as an air brush for spraying paints and lacquers and will be described with reference thereto; however, the invention is capable of broader application and could be used for spraying numerous other fluids.

Air brush type spraying apparatus are widely used, for example, by artists, model builders, and furniture refinishers for applying paints, stains, lacquers, and the like to any of a wide variety of surfaces. Currently available air brush apparatus is often relatively expensive, difficult to clean, and sometimes difficult to maintain. Usually, it is necessary to clean the apparatus each time the fluid being sprayed or its color is changed. Accordingly, there exists an ongoing need for a simple and comparatively inexpensive air brush type spraying apparatus.

BRIEF STATEMENT OF THE INVENTION

In accordance with the subject invention, apparatus is provided which generally overcomes the noted disadvantages of the prior art. Broadly, and in accordance with an aspect of the invention, an air brush apparatus is provided which generally includes a unitary.molded plastic frame having a collar portion with an axially extending central threaded opening. An integral support arm extends laterally from the collar and carries a vertically positioned, discharge nozzle support. A liquid container with a removable cap having an axially extending, external threadably cylindrical mounting hub is threaded received in the threaded opening in the collar portion. An eductor tube extends from the interior of the container into the mounting head in communication with a liquid discharge tip having an upwardly open end which extends axially outward of the mounting hub. A propellant fluid discharge nozzle is carried by the discharge nozzle support of the frame and has a propellant outlet port located to direct propellant transversely of the upwardly open end of the liquid discharge tip. Communicated with the propellant fluid discharge nozzle is a propellant fluid supply passage which extends vertically through the discharge nozzle support. A valve assembly is positioned in the nozzle support for controlling flow of propellant fluid through the supply passage. Preferably, the valve assembly includes biasing means for continually biasing the valve toward a closed position with an operating stem extending out of the nozzle support. A resilient operating lever is mounted to extend over the operating stem for permitting the operating stem to be selectively moved against the biasing means to move the valve to an open position.

According to a further aspect of the invention, adjusting means in the form of an eccentric cam are provided to control the movement of the valve operating stem to thereby control or regulate the quantity of propellant fluid flow. Preferably, the cam acts to limit movement of the operating lever to thus limit the movement of the valve operating stem.

Preferably, the valve operating stem is positioned in the propellant fluid supply passage and extends axially thereof. It is also preferable that the operating lever be a flexible and resilient integral portion of the molded plastic frame and that it extend with a first portion lying parallel to the nozzle support and a second portion extending laterally from the first portion and overlying the valve operating stem.

Because the liquid container is threadedly connected through its cap and mounting hub with the threaded collar of the frame, the entire combination of the liquid container and the liquid discharge tip are removed and replaced as a unit through a simple threading operation. In using the device, this allows quick changeover from one liquid to another without the necessity for cleaning the liquid discharge tip or the eductor tube assembly. A separate cap element can merely be placed over the liquid container and liquid discharge tip assembly which has been removed. The threaded connection between the container mounting hub and the central collar allows precision adjustment of the relationship between the liquid discharge tip and the propellant fluid discharge nozzle to thereby quickly adjust or control the spray and discharge quantities.

The overall assembly is extremely simple and can be formed from a minimum number of relatively inexpensive components. Additionally, assembly is greatly facilitated because the mounting collar, the support arm, the nozzle support, and the operating lever can all be a single, unitary plastic molding.

As is apparent from the foregoing, a primary object of the invention is the provision of a highly simplified, relatively inexpensive air brush apparatus.

A further object of the invention is the provision of an air brush apparatus of the general type described which functions with a minimum number of components and which can be quickly changed to dispense differing fluids without the necessity of extensive cleaning during the changeover process.

A further object is the provision of an apparatus of the type described which uses self-contained liquid containers and eductor tube/liquid discharge tips as a self-contained subassembly to facilitate quick changeover.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENTS

Referring more particularly to the drawings wherein the showings are for the purpose of illustrating a preferred embodiment of the invention only, and not for the purpose of limiting same, FIGS. 1 through 4 best illustrate the overall construction and arrangement of the air brush assembly 10 which generally comprises a combined main frame and propellant fluid nozzle assembly 12 which has a liquid container and discharge nozzle assembly 14 releasably associated therewith.

Figure 1:
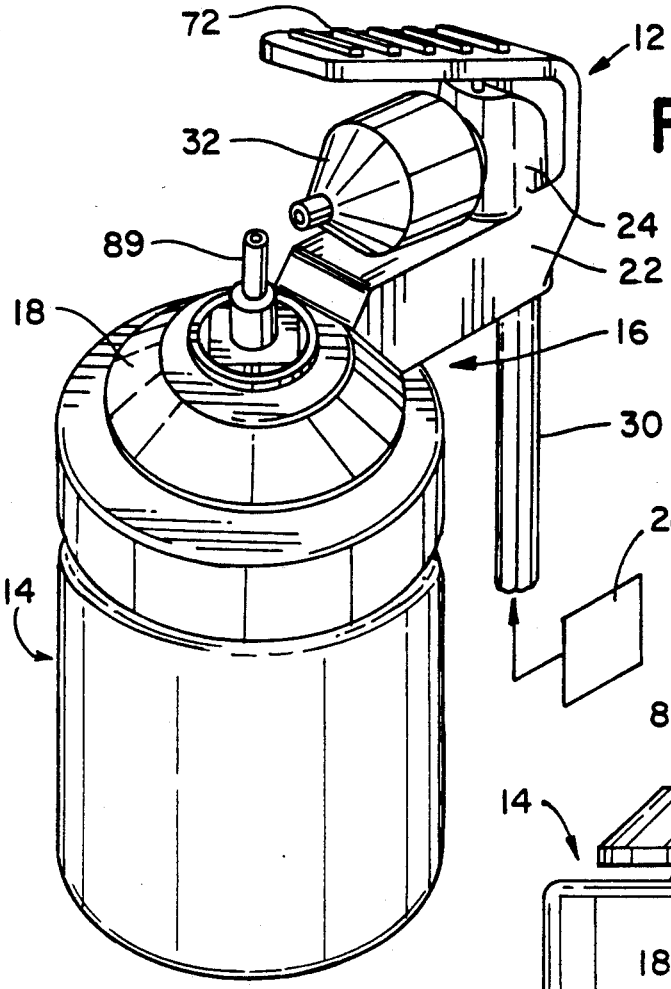
FIG. 1 is an isometric view of an air brush assembly formed in accordance with the preferred embodiment of the invention.
Figure 2:
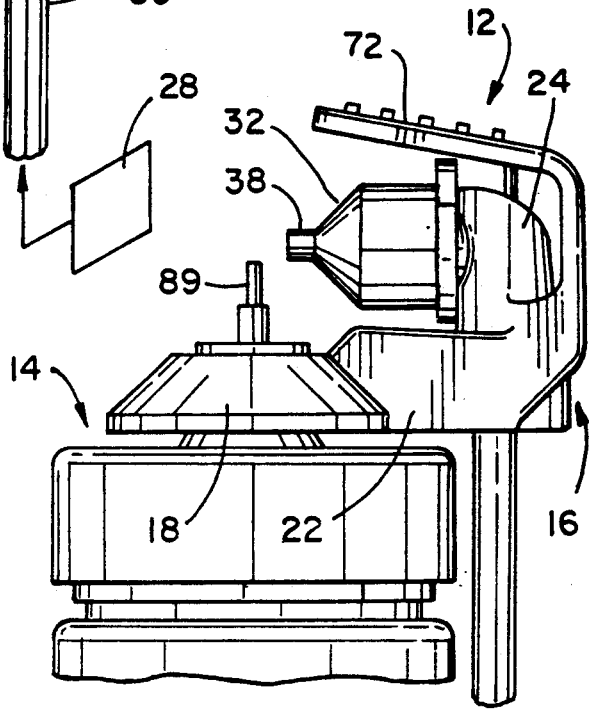
FIG. 2 is a side elevational view of the air brush frame and nozzle assembly (the liquid container is only partially shown)
Figure 3:
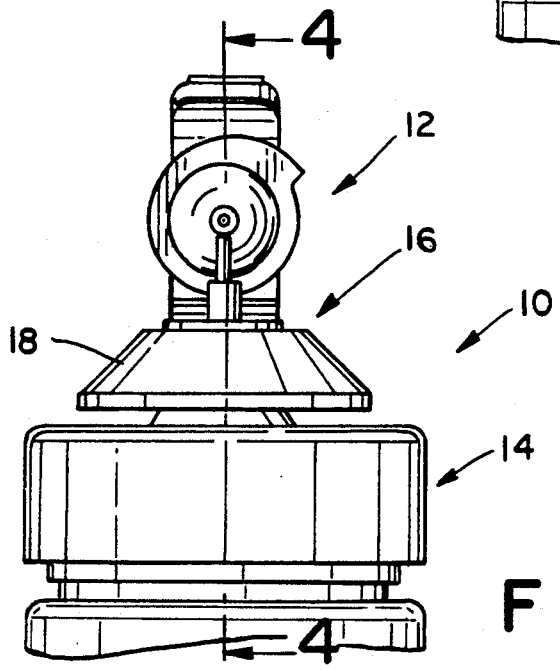
FIG. 3 is a front elevational view of the apparatus shown in FIG. 2.
Figure 4:
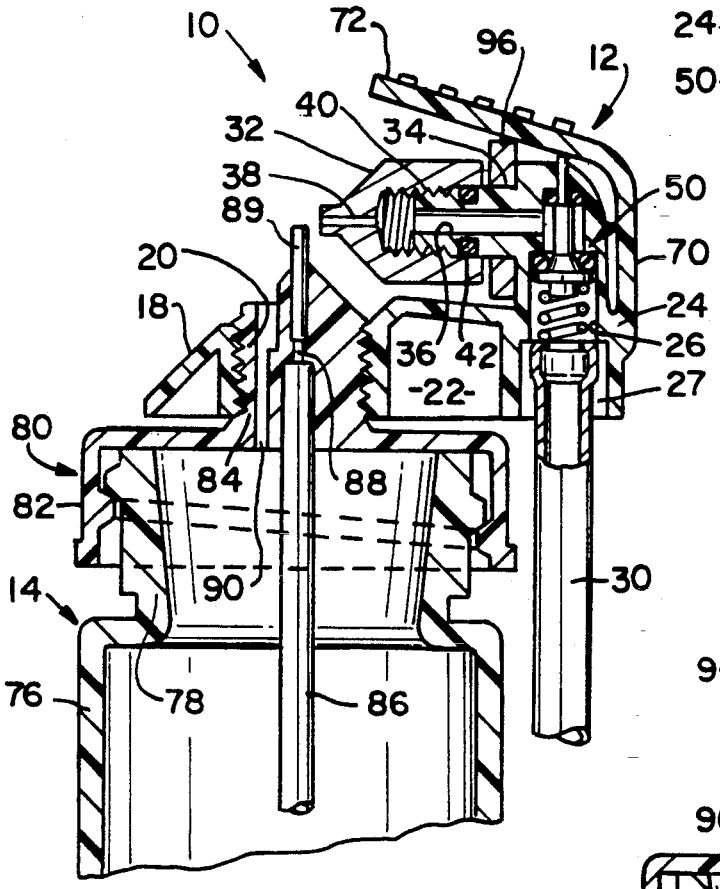
FIG. 4 is a cross-sectional view taken on line 4—4 of FIG. 3.

The main frame and discharge nozzle assembly generally comprises a unitary main frame unit 16 which is injection molded from plastic and includes an integral collar portion 18 having a truncated, conical configuration and provided with an axially extending, threaded through opening 20. Frame unit 16 further includes a support arm 22 extends laterally from the collar 18 and is molded integrally therewith. As best shown in FIG. 4, the collar 18 and the laterally extending support arm 22 are preferably generally hollow and open downwardly, but present a smooth continuous exterior surface on the lateral sides and top.

Figure 5:
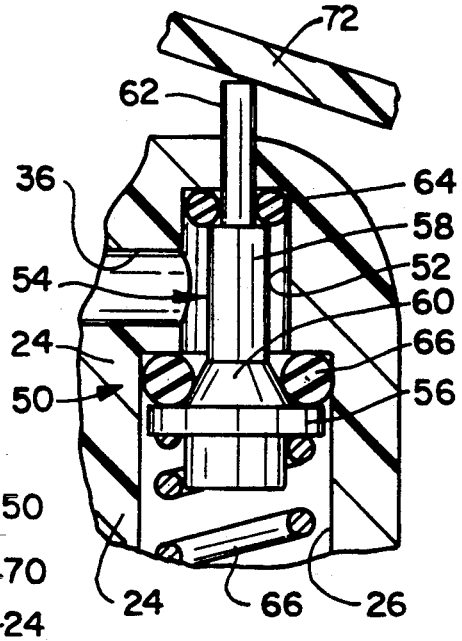
FIG. 5 is a greatly enlarged view of the circled portion of FIG. 4; and, FIG. 6 is a vertical cross-sectional view through the liquid container and its associated cap and liquid discharge tip assembly.

Supported at the outer free end of the laterally extending support arm 22 is a vertically extending discharge nozzle support post 24. The discharge nozzle support post 24 is also molded integrally with the collar 18 and the support arm 22 as part of the main frame 16. A stepped diameter, propellant fluid supply passage 26 (see FIGS. 4 and 5) is formed axially upward through the discharge nozzle support post 24. A source of pressurized propellant fluid in the form of air or gas is connected to passage 26 from a source 28, such as a compressor shown diagrammatically in FIG. 1, through a tube 30 suitably connected to the lower or inlet end of the passage 26 through an insert 27. It should be seen that passage 26 preferably extends generally parallel to the axis of the collar 18.

A propellant fluid discharge nozzle 32 is suitably supported from the nozzle support post 4 by a laterally extending stud 34. The stud 34 is molded integrally with the nozzle support post 24 and has a central flow passage 36 extending axially thereof for communication with the vertical propellant fluid supply passage 26.

The nozzle 32 is, in the subject embodiment, machined from brass and has a discharge orifice 38 which is aligned to discharge perpendicular to the axis of the collar 18 at the location shown. Preferably, and for reasons which will subsequently be described, the nozzle 32 is threadedly connected to the stud 34 by cooperating threads shown generally at 40. A suitable 0-ring 42 is carried in a groove formed externally about the stud 34 inwardly of the threads 40. A cooperating nonthreaded portion of the nozzle 32 engages the 0-ring 42 to provide a fluid seal.

The flow of propellant fluid through the supply passage 26 to the nozzle passage 36 is controlled by a valve assembly 50 which is mounted in supply passage 26. The overall construction and arrangement of the valve assembly 50 can best be understood by reference to FIGURE 5. As shown therein, the supply passage 26 has a reduced diameter intermediate passageway portion 52 which carries the cylindrical steppedriaeter valve element 54. The valve element 54 includes a lower, relatively large diameter valving section 56 which connects with the central section 58 by a conical transition portion 60. A small diameter operating shaft portion 62 extends outwardly of the upper end of the discharge nozzle support post 24. A suitable 0-ring 64 is closely received about the lower portion of the operating shaft 62 to seal the stem or operating shaft at its point of exit from the nozzle support. A second 0-ring 66 is positioned at the juncture between the lower, larger diameter portion of passageway 26 and the somewhat smaller diameter intermediate passageway portion S2. This 0-ring 66 serves as the valve seat for the large diameter valving portion 56.

The valve assembly S4 is shown in the closed position in FIGURE S. It is generally maintained in this closed position by being biased upwardly through the use of a compression coil spring 67 which is positioned between the bottom of the valve 54 and the upper or inner end of the insert 27. By forcing the operating shaft 62 downwardly to move the valve element away from the seat O-ring 66, fluid is allowed to enter the lateral passageway 36 for discharge from nozzle 32.

In the embodiment under consideration, the control of the valve and operation of the operating shaft 62 is accomplished by an operating lever having a vertical portion 70 and a laterally extending portion 72. The lever is molded integrally with the main frame unit 16 and is sufficiently flexible and resilient to allow it to deflect under the pressure of the operator's index finger, for example, to force the valve downwardly to an open position upondeflectionof theoperatinglever. Whenreleased, the lever 54 returns to its upper position to allow the valve to return to a closed position.

The quantity of propellant fluid dispensed can be controlled by control means which adjustably limit the degree of opening of the valve assembly 50. In this embodiment, this function is accomplished by a rotary eccentric cam 96 that is carried on the stud 34 adjacent nozzle support post 24. The cam 96 is frictionally engaged with the exterior of stud 34 but can be manually rotated to bring different portions of its peripheral surface into position beneath lever portion 72. This controls the amount which the operating lever can be depressed and thus controls the amount that the operating shaft portion 62 will be depressed to open valve element 54.

Figure 6:
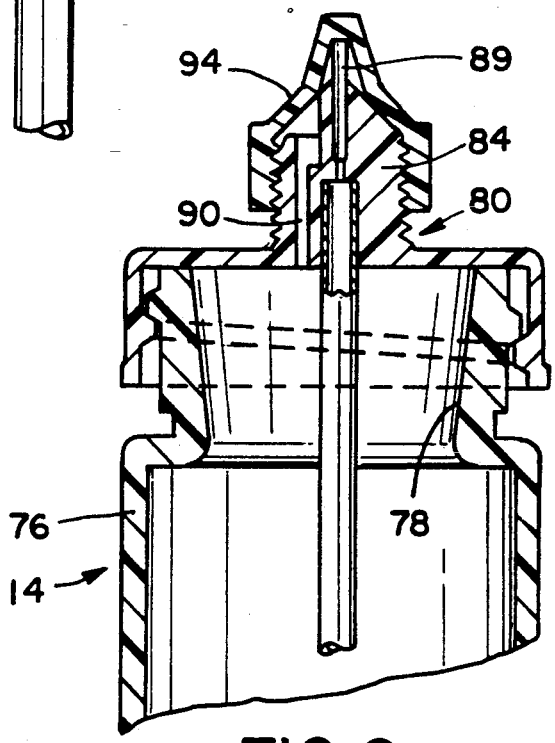

Referring to FIGS. 4 and 6, the details of the preferred form for the liquid container and liquid discharge tip assembly can best be understood. As shown therein, assembly 14 includes a suitable liquid supply container 76 which is formed from any suitable material, for example, glass or plastic, and has an open upper end 78 to which is threadedly connected a cap and nozzle tip unit 80. The cap has a downwardly extending flange portion 82 which is threadedly received on of container 76. In the embodiment shown, the cap and nozzle tip 82 further includes a centrally located, integral mounting hub 84 which is externally threaded to be received within the threaded opening 20 of the collar 18. The threaded connection between the collar 18 and the hub 84 allows for ready vertical adjustment of the container and liquid discharge tip assembly relative to the collar IS to produce suitable alignment with the discharge orifice 38. In addition, it allows quick changeover from one container and discharge tip assembly to another as desired for changing the liquid being dispensed or its color.

As illustrated in FIGS. 4 and 6, the hub 84 has an eductor tube 86 extending to the bottom of container 76. The upper end of the eductor tube 86 extends axially into the hub 84 and has its interior in fluid communication with a vertically extending passage 88 that leads to the inlet of a liquid discharge tip 89. The discharge tip 89 is preferably formed from metal and has an upper end which is open and aligned with the orifice 38 from the propellant fluid supply nozzle. As can be appreciated, the relative adjustability of the tip 89 and the nozzle 32 allows precise control of the propellant fluid relative to the discharge tip 89 to produce the most desirable spray quantity and dispersion as required.

It should also be noted that the hub 84 includes vertically extending air passages or openings 90 which maintain the interior of the container 76 at atmospheric pressure even when fluid is being drawn therefrom through the eductor tube 86. Because of the threaded arrangement between the mounting hub 84 and the mounting collar 18, it is simple to quickly remove the container and discharge tip assembly and replace it with a different one as necessary or desired. When removed, it is possible to provide the mounting hub and the associated discharge tip with a suitable cover 94 as illustrated in FIG. 6. As can be appreciated, this combined removal and replacement of the entire container and discharge tip assembly eliminates the need for cleaning between changeovers of the liquids being dispensed. Additionally, it should be seen from the foregoing that the resulting structure has a minimum number of component parts and, as a consequence, can be produced relatively inexpensively and requires a minimum of assembly.

The invention has been described with reference to the preferred embodiment. obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. An air brush apparatus comprising:

a molded plastic frame including a collar portion with an integral support arm extending laterally therefrom and carrying a vertically positioned discharge nozzle support, a threaded opening extending axially through the collar portion;

a liquid container having a removable cap with an axially extending, externally threaded cylindrical mounting hub threadedly received inthe threaded opening in the collar portion for permitting vertical adjustment of the container;

an eductor tube extending from the interior of the container into the mounting hub and a liquid discharge tip having an upwardly open and extending axially outward of the mounting hub and communicating with the eductor tube;

a propellant outlet portion located to direct propellant transversely of the upwardly open end of the liquid discharge tip;

a propellant fluid supply passage extending through the discharge nozzle support and communicated with the propellant fluid discharge nozzle; and, a valve assembly positioned in the nozzle support for controlling flow of propellant fluid throuhg the supply passage, the valve assemblyincluidng bieasing means biasing the valve to a closed position and hving an operating stem extending out of the nozzle support and an operating lever extending over the operating stem for permitting the operating stem to be selectively moved against the biasing means to move the valve to an open position.

2. The air brush apparatus as defined in claim 1 wherein the propellant fluid discharge nozzle is threadedly connected to the discharge nozzle support to provide adjustability in a direction transverse to the axis of the liquid discharge tip.

3. The air brush apparatus as defined in claim 2 wherein the valve operating stem extends axially of the propellant fluid supply passage.

4. The air brush apparatus as defined in claim 1 wherein the operating lever is resilient and molded integrally with the frame and extends upwardly from the support arm.

5. The air brush apparatus as def ined in claim 4 wherein the resilient operating lever has a first portion extending generally parallel to the nozzle support and a second portion extending laterally from the first portion and overlying the valve operating stem.

6. The air brush apparatus as defined in claim 1 wherein the externally threaded cylindrical mounting hub is molded of plastic.

7. The air brush apparatus as defined in claim 1 including adjustable control means for regulating the amount of propellant fluid discharged through the discharge nozzle.

8. The air brush apparatus as defined in claim 7 wherein the adjustable control means includes a movable cam for limiting the movement of the operating lever.

9. The air brush apparatus as defined in claim 8 wherein the movable cam is carried adjacent the discahrge nozzle.

10. The air brush apparatus as defined in claim 9 wherein the movable cam is mounted for rotary movement.

11. The air brush apparatus as defined in claim 7 wherein the adjustable control means comprises means for limiting the movement of the operating lever.

12. An air brush apparaus comprising:

a molded plastic frame including a collar portion with an integral support arm extending laterally therefrom and carrying a vertically positioned discharge nozzle support, a threaded opening extending axially through the collar portion;

a liquid container hving a removable cap with an axially extending, externally threaded cylindrical mounting hub threadedly received in the threaded opening in the collar portion;

an eductor tube extending from the interior of the container into the mounting hub and a liquid discharge tip having an upwardly open end extending axially outward of the mounting hub and communicating with the eductor tube;

a propellant fluid discharge nozzle carried by the discharge nozzle support and having a propellant outlet port located to direct propellant transversely of the upwardly open end of the liquid discharge tip;

a propellant fluid supply passage extending through the discharge nozzle support and communicated with the propellant fluid discharge nozzle; and, a valve assembly positioned in the nozzle support for controlling flow of propellant fluid through the supply passage, the valve assembly including biasing means biasing the valve to a closed position and having an operating stem extending out of the nozzle support and a resilient operating lever molded integrally with the frame and extending upwardly over the operating stem for permitting the operating stem to be selectively moved against the biasing means to move the valve to an open position.

13. The air brush apparatus as defined in claim 12 wherein the resilient operating lever as a first portion extending generally parallel to the nozzle support and a second portion extending laterally from the first portion and overlying the valve operating stem.

* * * * *